US006374654B1

(12) United States Patent
Stefanescu

(10) Patent No.: US 6,374,654 B1
(45) Date of Patent: Apr. 23, 2002

(54) LOCKING ARRANGEMENT COMPRISING A LOCK CYLINDER AND AN ASSOCIATED KEY

(75) Inventor: Alexander Stefanescu, Düsseldorf (DE)

(73) Assignee: C. Ed. Schulte Gesellschaft mit beschränker Haftung Zylinder-schlossfabrik, Velbert (DE)

( * ) Notice: Subject to any disclaimer, the term of this patent is extended or adjusted under 35 U.S.C. 154(b) by 0 days.

(21) Appl. No.: 09/565,845

(22) Filed: May 5, 2000

(30) Foreign Application Priority Data

May 8, 1999 (DE) ..... 199 21 454
Jan. 5, 2000 (DE) ..... 100 00 194

(51) Int. Cl.[7] ..... E05B 15/08
(52) U.S. Cl. ..... 70/453; 70/407; 70/409
(58) Field of Search ..... 70/423, 427, 453, 70/454, 465, 407, 409, 411

(56) References Cited

U.S. PATENT DOCUMENTS

| | | | | | |
|---|---|---|---|---|---|
| RE9,787 | E | * | 7/1881 | Schade | 70/453 X |
| 437,939 | A | * | 10/1890 | Sargent | 70/453 X |
| 688,052 | A | * | 12/1901 | Allen | 70/453 |
| 748,394 | A | * | 12/1903 | Martin | 70/453 X |
| 2,598,376 | A | * | 5/1952 | Heinz | 70/454 X |
| 3,352,135 | A | * | 11/1967 | Spain | 70/453 X |
| 4,612,787 | A | * | 9/1986 | Prunbauer et al. | 70/409 X |
| 4,686,843 | A | * | 8/1987 | Martikainen et al. | 70/453 X |
| 5,076,081 | A | * | 12/1991 | Borsi, Jr. | 70/409 X |
| 5,088,306 | A | * | 2/1992 | Field | 70/453 X |
| 5,287,712 | A | * | 2/1994 | Sieg | 70/409 X |
| 5,349,830 | A | * | 9/1994 | Keller | 70/409 X |
| 5,477,713 | A | * | 12/1995 | Lay | 70/454 |
| 5,490,405 | A | * | 2/1996 | Ramo et al. | 70/409 X |
| 5,502,991 | A | * | 4/1996 | Sornes | 70/453 |
| 5,778,712 | A | * | 7/1998 | Wallden | 70/453 |
| 5,845,525 | A | * | 12/1998 | Widen | 70/453 X |
| 6,145,357 | A | * | 11/2000 | Stefanescu | 70/407 X |

FOREIGN PATENT DOCUMENTS

| | | | | |
|---|---|---|---|---|
| DE | 380476 | * | 9/1923 | 70/407 |
| DE | 3713364 | * | 11/1988 | 70/453 |
| EP | 546912 | * | 6/1993 | 70/409 |

* cited by examiner

*Primary Examiner*—Suzanne Dino Barrett
(74) *Attorney, Agent, or Firm*—Martin A. Farber

(57) ABSTRACT

Locking arrangement having a lock cylinder with an associated key (1), in particular a flat turning key, wherein a core (2) of the lock cylinder has a keyway (3) which is open in the direction of an end side of the cylinder, is provided with profile ribs/grooves and in the center thereof the vertex of a conical opening (4), which opens in the direction of the end side of the cylinder, is located. At an insertion end, the key (1) forms a tip (5) with flanks (6) in the form of arcuate lines. The tip (5) is formed by two arcuate lines (6), of which a point of intersection is located in a broad-side center (7) of the key, and a tangent angle (delta) at the point of intersection (5) is greater than the vertex angle ($\mu$) of the cone opening (4), wherein the arcuate lines (6) have bevels (9), in the direction of the mutually opposite broad sides (8), having a bevel angle (omega) which is smaller than the vertex angle ($\mu$) of the cone opening (4).

14 Claims, 3 Drawing Sheets

LOCKING ARRANGEMENT COMPRISING A LOCK CYLINDER AND AN ASSOCIATED KEY

FIELD AND BACKGROUND OF THE INVENTION

The invention relates to a locking arrangement and to the associated key.

A locking arrangement having a lock cylinder and an associated key, in particular flat turning key, is known in the prior art. In this case, the core of the lock cylinder has a keyway which is open in the direction of the end side of the cylinder and is provided with profile ribs/grooves. The vertex of a conical opening, which opens in the direction of the end side of the cylinder, is located in the centre of said keyway. At its insertion end, the key forms a tip with flanks in the form of arcuate lines. The combination of conical opening and tip with arcuate flanks is intended to facilitate the introduction of the key into the keyway. The introduction of the key is complicated, in particular, in the case of flat turning keys with narrow profile ribs/grooves. On account of the profilings located closely adjacent to one another, the key has to be inserted without deviating to any great extent from the precisely aligned position. Furthermore, locking systems profiled in this way barely allow any positions in which the key axis is inclined to any greater extent in relation to the keyway axis.

The prior art also proposes a solution in which, rather than being rounded, the key has a tip formed by two rectilinear flanks.

SUMMARY OF THE INVENTION

The object of the invention is to facilitate the introduction of a key into the keyway.

According to the invention. The tip is formed by two arcuate lines, of which the point of intersection is located in the broad-side centre of the key, and the tangent angle at the point of intersection is greater than the vertex angle of the cone opening, it being the case that the arcuate lines have bevels, in the direction of the mutually opposite broad sides, having a bevel angle which is smaller than the vertex angle of the cone opening. The conical opening forms a type of funnel which opens out into the keyway. The key is inserted in said funnel. It is generally the case that the key axis is not in alignment with the keyway axis. Rather, the key axis is tilted by an angle of inclination in relation to the keyway axis. It is likewise the case that the key shank is rotated by an angle of rotation in relation to the orientation of the keyway. In the rotated position, the arcuate lines are in tangential contact with the cone wall within a broad-side pivoting region. This broad-side pivoting region is bounded by the pivot position in which the tip of the key shank, which is formed by the point of inter-section of the arcuate lines, comes into abutment against the cone wall. Within the broad-side pivoting region, the key tip is spaced apart from the vertex of the cone and projects therein in a contactless manner. The key may also be pivoted through a narrow-side pivoting region in relation to the keyway axis. The narrow-side pivoting region is bounded by the bevel angle. Within the narrow-side pivoting region, the key, with its tip located, in the cone, can be pivoted to the extent where the bevels come into abutment against the cone wall. If the key is inserted into the cone in a state in which it is rotated in relation to the orientation of the keyway, then the pivoting into the above-defined broad-side pivoting region is simplified by the geometry. The user feels the pivot angle at which the tip moves away from the abutment against the cone wall. If the user has the key in this broad-side pivoting region and rotates the key, then the key tip finds its correct, central position in relation to the keyway and with the correct rotary orientation, on account of the bevels, can be inserted into the keyway. The slopes of the bevel which then take effect cause the key to be righted into the aligned position. If the key is rotated out of a position in which the key axis is located in the broad-side pivoting region, until the correct rotary orientation has been reached, then the narrow side is also oriented in the narrow-side pivoting region. This means that, in this position, it is only the end edges of the flank which butt against the cone wall. In a preferred configuration, the bevel angle is greater approximately by 15 to 25° than half the vertex angle of the cone. The thickness of the non-bevelled flank section is approximately half to a third of the narrow-side thickness. The result of this is that the key, located in the correctly oriented position, then, upon further pushing in the keyway, is pivoted virtually automatically out of the inclined position into the aligned position, if its inclined position is located within the narrow-side pivoting region. The arcuate lines are preferable circle arcs. The centres are located in the broad side of the key and are spaced apart from the broad-side centre line by a distance. This distance corresponds approximately to 30 to 35% of the broad-side thickness of the key. Furthermore, the radius of the arcuate side is preferably approximately 105 to 110% of the thickness of the broad side of the key. The diameter of the cone opening is preferably smaller than the broad-side thickness of the key. The cone angle, that is to say the vertex angle of the funnel-shaped opening, is preferably approximately 110°. A development of the invention relates to the cone opening of the cylinder core. The vertex angle of the conical opening is greater on the outside of the opening than in the centre of the opening. The opening preferably forms an inner cone with a smaller vertex angle than the outer cone. According to one development, the inner cone is in the form of an oval. The oval is directed longitudinally in relation to the keyway. This produces, in the region of the keyway, a step-shaped transition between the two cone walls. In the direction transverse to this, the transition is formed as an edge. The vertex angle of the more pointed, inner cone, is preferably 90°.

The invention also relates, in particular, to a key for the locking arrangement described.

BRIEF DESCRIPTION OF THE DRAWINGS

An exemplary embodiment of the invention will be explained with reference to attached drawings, in which.

DETAILED DESCRIPTION OF THE PREFERRED EMBODIMENT

Figure 1:
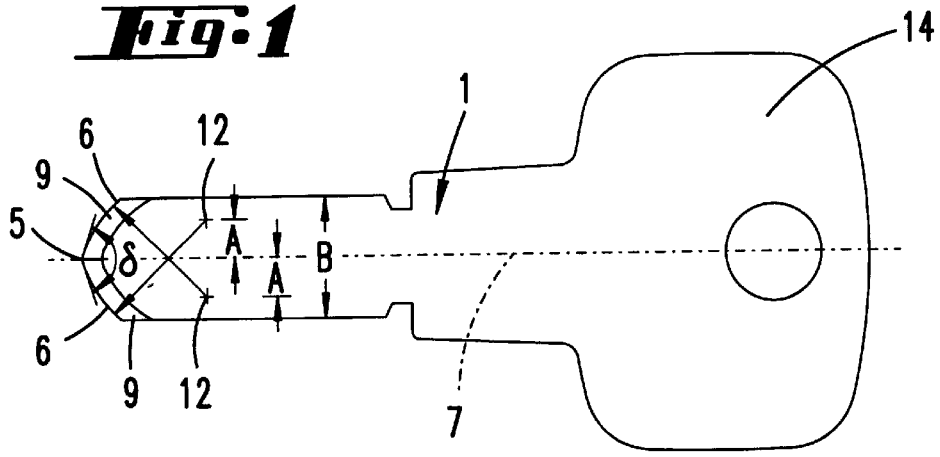
FIG. 1 shows a schematic illustration of a plan view of a key according to the invention.

The key 1 has a key grip 14 and a tip 5 located opposite said grip 14. The tip 5 is located in the broad-side centre 7. The tip 5 is flanked by flanks 6 in the form of arcuate lines. The flanks 6 are generated by circle arcs which are described around the arc centre 12 with a radius R. The arc centres 12 are located in the broad side 8 of the key, to be precise spaced apart from the broad-side centre line 7 in each case by a distance A. The distance A is 30 to 35% of the width B of the broad side of the key.

The arcuate lines 6 intersect at the tip 5 such that the tangent angle delta of the arcuate lines 6 at the point of intersection 5 is greater than the vertex angle My ($\mu$) of a cone opening 4, which is located on the end side of a core 2 of a lock cylinder.

Figure 2:
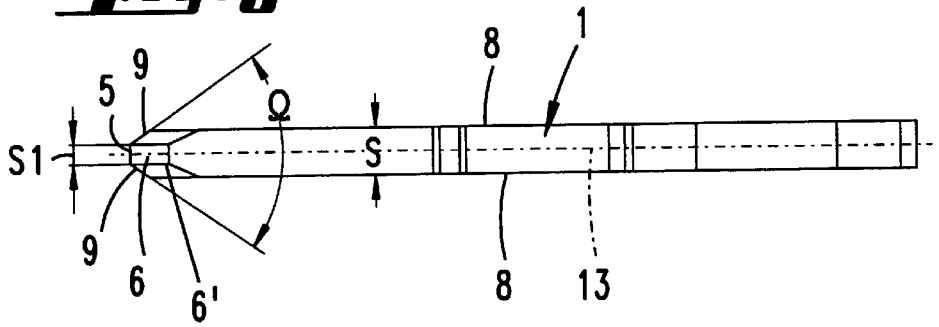
FIG. 2 shows a side view of the key according to FIG. 1.
Figure 3:
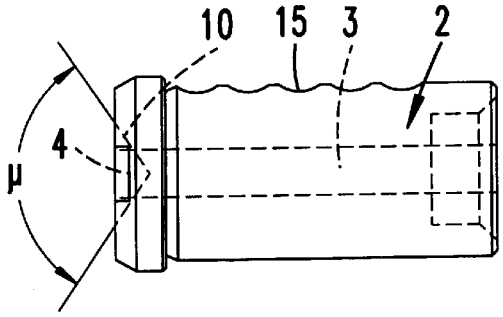
FIG. 3 shows the schematic illustration of a core of a lock cylinder according to the invention, in elevation.
Figure 4:
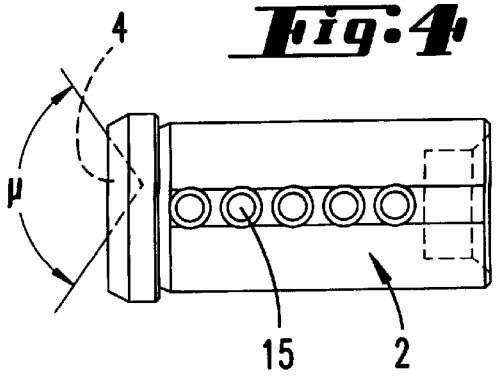
FIG. 4 shows an illustration according to FIG. 3 with the viewing direction rotated through 90°.
Figure 5:
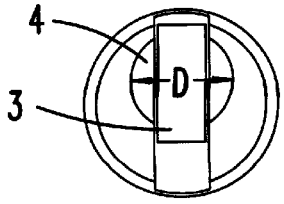
FIG. 5 shows a front view of the lock-cylinder core.

As can best be seen from FIG. 2, the arcuate line 6 forms a flank end section spaced apart from the broad sides 8. This arcuate end section has a width S1 and is aligned transversely to the extent of the broad-side surfaces 8. The thickness of said flank end section is approximately half to a third of the narrow-side thickness S. Said flank end section merges into the broad side 8, a bevel 9 being formed in the process. The bevel angle omega is smaller than half the cone angle My ($\mu$). The cone angle My is approximately 110°. The bevel angle omega is approximately 15 to 25° greater than half the cone angle My ($\mu$). The thickness of the bevels 9 are the same on each of the two broad sides 8 of the key. This means that the bevels 9 are each spaced apart from the narrow-side centre 13 by the same distance.

Figure 6:
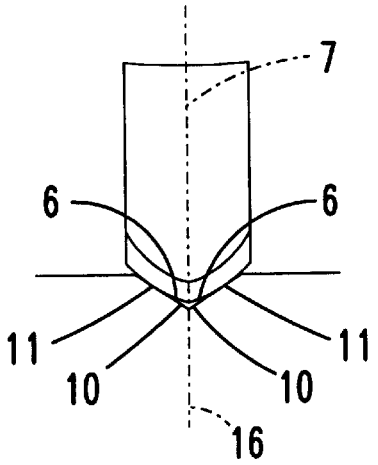
FIG. 6 shows a schematic illustration of the key tip located in the cone opening in a state in which it is rotated through approximately 90° in relation to the orientation of the keyway, with a view of the broad side.

FIGS. 6 to 9 illustrate schematically the positions which the key 1 can assume within the cone opening 4. In FIG. 6, the key 1, placed transversely to the orientation of the keyway, is positioned against the cone wall 10 by way of its flank 6 such that the end side of the flank 6 butts tangentially against the cone wall 10 at the locations 11. In this position, the longitudinal centre axis of the key is in alignment with the keyway axis. The key 1 may be pivoted through a broad-side pivoting region alpha, the tangential abutment of the flanks 6 against the cone wall 10 being maintained in the process. If the boundary angle of the broad-side pivoting region alpha is reached (FIG. 7), then the broad-side centre line 7 is in a state in which it is pivoted by the angle alpha in relation to the keyway axis 16. In this position, the tip 5 of the key butts against the cone wall 10. With this position, there is only one point 11 of tangential abutment of the flank 6 against the cone wall 10. If the key is pivoted out of this position to a greater pivot angle alpha, then the tip 5 slides on the cone wall to the opening border of the cone.

Figure 7:
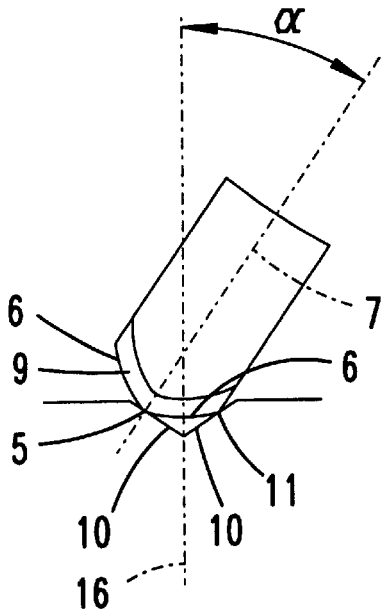
FIG. 7 shows the illustration of the boundary of the broad-side pivoting region alpha.

If the key 1 is pivoted out of such a position with a relatively large pivot angle alpha, by the position illustrated in FIG. 7, to smaller angles alpha, then it is possible to feel the transition point to the entry into the broad-side pivoting region, said transition point being illustrated in FIG. 7. In this case, the key tip 5 approaches the vertex of the conical opening 4.

Once the broad-side pivoting region alpha, within which the two flanks 6 are in tangential abutment 11 against the cone wall 10, has been reached, then the key 11 can be rotated about its key axis until it is correctly oriented in relation to the keyway 3. In this position, on account of the bevel angle omega selected, the tip of the key 1 can be inserted in the keyway, the border edge of the keyway 3 running on the bevel 9. The result of this is that, as the key 1 is pushed further into the keyway 3, the key is aligned such that the narrow-side pivot angle beta decreases until the longitudinal centre axis of the key is in alignment with the keyway axis 16.

Figure 8:
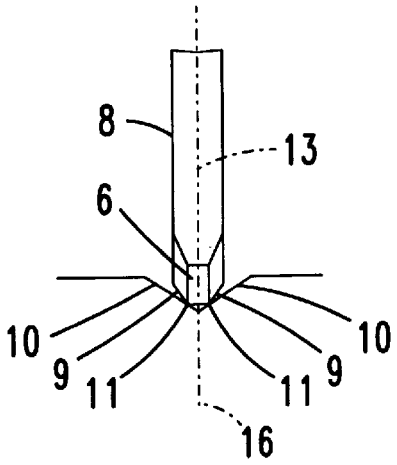
FIG. 8 shows the narrow-side view of a key fitted into the cone by way of the tip and in an aligned position in relation to the keyway axis.
Figure 9:
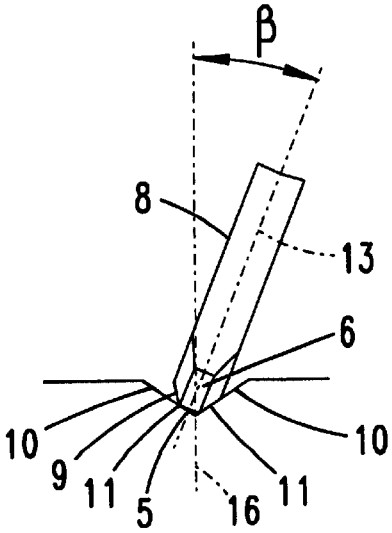
FIG. 9 shows the boundary region of the narrow-side pivoting region.

FIG. 8 illustrates an insertion position of the key 1 in which the narrow-side centre line 13 is not pivoted in relation to the keyway axis 16. The maximum permissible pivoting made possible by the selection of the bevel angle omega is illustrated in FIG. 9. This pivot position defines the boundary angle of the narrow-side pivoting region beta, within which a border edge 6' of the flank 6 still butts against the cone wall 10.

On account of the dimensioning according to the invention of the arcuate-line flanks 6 of the end of the key 1 in relation to the vertex angle My of the conical opening 4, insertion is particularly facilitated. The key, which is usually inserted in a state in which it is rotated in relation to the orientation of the keyway, is first of all brought into a pivot position in which the key axis is located within a broad-side pivoting region alpha in relation to the keyway axis 16. The user can feel when this region has been reached. The key 1 is then rotated in relation to the cylinder core 2 until it is oriented correctly in relation to the keyway 3. During this rotation, the pivot angle of the longitudinal centre axis of the key in relation to the keyway axis 16 is substantially maintained, with the result that, once pivoting has taken place, the longitudinal centre axis of the key is located in a pivot position in relation to the keyway axis 16 such that the angle between the keyway axis 16 and the narrow-side centre line 13 is located within a narrow-side pivoting region beta. Within the narrow-side pivoting region beta, the tip 5 of the key 1, said tip being narrowed to a width S1 on account of the bevels 9, can pass into the keyway 3. Since the vertex of the conical opening 4 is located in the centre of the keyway 3, the key 1 is also centred in relation to the keyway 3, this achieving the aligned position in relation to the profiling.

Figure 12:
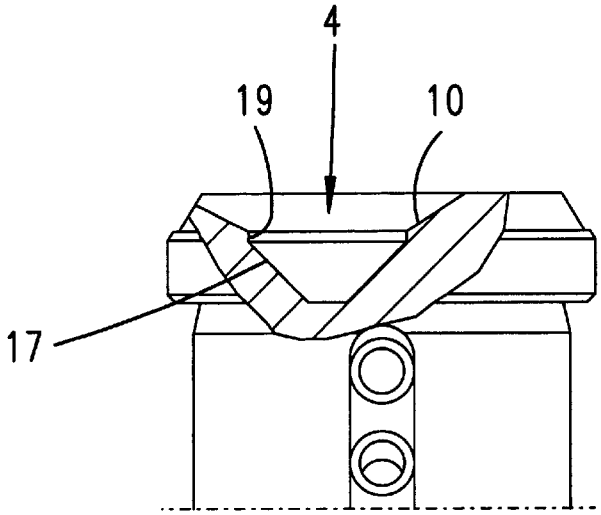
FIG. 12 shows a side view, rotated through 90°, in longitudinal section through the keyway, partly cut away.
Figure 11:
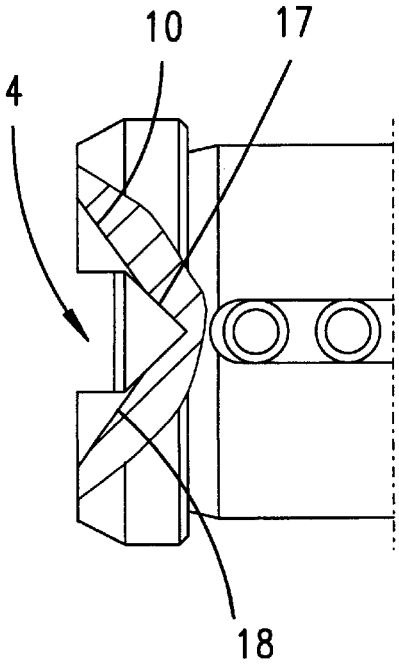
FIG. 11 shows a side view with the cone opening partly cut away.
Figure 10:
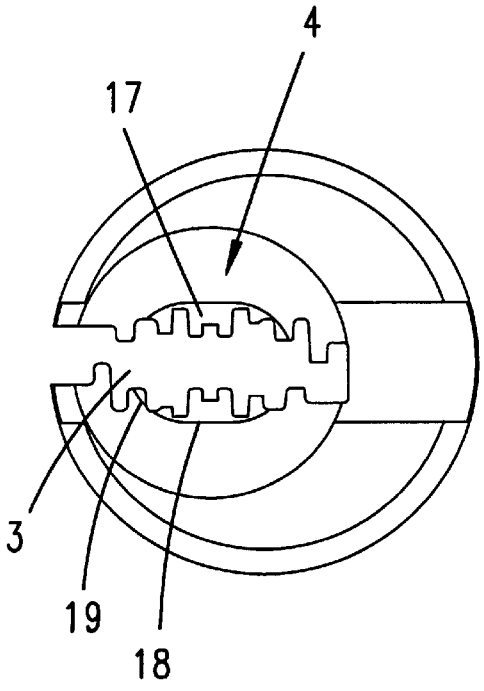
FIG. 10 shows a plan view of the end side of a lock-cylinder core of a second exemplary embodiment.

In the exemplary embodiment illustrated in FIGS. 10 to 12, the conical opening 4 has a vertex angle of 110° in the outer region. An inner cone 17, with a vertex angle of 90°, is located in the centre of the opening 4. The inner cone 17 is in the form of an oval. While the circular diameter of the outer cone border is 9 mm, the smallest diameter of the inner cone is 4 mm. The maximum diameter of the inner cone border is 5.5 mm. On account of the oval outline of the inner cone 17, the latter merges, in certain regions, into the wall of the outer cone 4 with an edge 18 being formed in the process. In the region of the narrow sides of the inner cone 17, the latter merges into the outer cone 4 with a step 19 being formed in the process.

The inner cone is produced by means of a conical milling cutter. Once it has reached its penetration depth, said milling cutter is displaced along the keyway 3, thus producing the oval contour of the inner cone 17.

I claim:

1. Locking arrangement having a lock cylinder with an associated key (1), in particular a flat turning key, wherein a core (2) of the lock cylinder has a keyway (3) which is open in the direction of an end side of the cylinder, is provided with profile ribs/grooves and in the centre thereof the vertex of a conical opening (4), which opens in the direction of the end side of the cylinder, is located, wherein, at an insertion end, the key (1) forms a tip (5) with flanks (6) in the form of arcuate lines, wherein the tip (5) is formed by two arcuate lines (6), of which a point of intersection is located in a broad-side centre (7) of the key, and a tangent angle (delta) at the point of intersection (5) is greater than the vertex angle ($\mu$) of the cone opening (4), wherein the arcuate lines (6) have bevels (9), in the direction of the mutually opposite broad sides (8), having a bevel angle (omega) which is smaller than the vertex angle ($\mu$) of the cone opening (4).

2. Locking arrangement according to claim 1, wherein a narrow-side pivoting region (beta), which is made possible by the difference between the vertex angle ($\mu$) and bevel angle (omega), is equal to, or preferably larger than, the broad-side pivoting region (alpha), within which the arcuate lines (6) are in tangential abutment (11) against the cone wall (10).

3. Locking arrangement according to claim 1, wherein the bevel angle (omega) is approximately 15° to 25° greater than half the vertex angle ($\mu$) of the cone.

4. Locking arrangement according to claim 1, wherein the thickness of a non-bevelled flank section (S1) corresponds approximately to half to a third of narrow-side thickness (S).

5. Locking arrangement according to claim 1, wherein the arcuate lines (6) are circle arcs, of which the centres (12) are located in the broad side (8) of the key and are spaced apart from the broad-side centre line (7) in each case by a distance (A) corresponding to 30 to 35% of the broad-side thickness (B) of the key.

6. Locking arrangement according to claim 1, wherein radius (R) of the arcuate lines (6) corresponds approximately to 105 to 110% of the broad-side thickness (B) of the key.

7. Locking arrangement according to claim 1, wherein the diameter (D) of the cone opening (4) is smaller than the broad-side thickness (B) of the key.

8. Locking arrangement according to claim 1, wherein the vertex angle ($\mu$) of the cone is approximately 110°.

9. Locking arrangement according to claim 1, wherein the vertex angle of the conical opening (4) is greater on the outside of the opening than in the centre of the opening.

10. Locking arrangement according to claim 1, wherein the opening (4) forms an inner cone (17) with a smaller vertex angle.

11. Locking arrangement according to claim 10, wherein the inner cone (17) is in the form of an oval, the latter being directed longitudinally in relation to keyway (3).

12. Key for a locking arrangement, in particular according to claim 1, wherein at its insertion end, the key forms a tip (5) with flanks (6) in the form of arcuate lines, wherein the tip (5) is formed by two arcuate lines (6), of which the point of intersection is located in the broad-side centre (7) of the key, and the tangent angle (delta) at the point of intersection (5) is greater than 110°, wherein the arcuate lines (6) have bevels, in the direction of the mutually opposite broad sides (8), having a bevel angle (omega) which is smaller than the tangent angle (delta).

13. Lock cylinder for a locking arrangement, in particular according to claim 1, wherein the core (2) of the lock cylinder has a keyway (3) which is open in the direction of the end side of the cylinder, is provided with profile ribs/grooves and in the centre thereof the vertex of a conical opening (4), which opens in the direction of the end side of the cylinder, is located, wherein the vertex angle of the conical opening (4) is greater on the outside of the opening than in the centre of the opening.

14. Lock cylinder according to claim 13, wherein the inner cone is in the form of an oval, the latter being directed longitudinally in relation to the keyway (3).

* * * * *